US009341372B2

(12) United States Patent
Penz

(10) Patent No.: US 9,341,372 B2
(45) Date of Patent: May 17, 2016

(54) TILE FASTENING ARRANGEMENT OF A GAS-TURBINE COMBUSTION CHAMBER

(71) Applicant: Rolls-Royce Deutschland Ltd & Co KG, Blankenfelde-Mahlow (DE)

(72) Inventor: Stefan Penz, Werneuchen (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 408 days.

(21) Appl. No.: 14/079,293

(22) Filed: Nov. 13, 2013

(65) Prior Publication Data

US 2014/0144146 A1 May 29, 2014

(30) Foreign Application Priority Data

Nov. 28, 2012 (DE) ..... 10 2012 023 297

(51) Int. Cl.

*F23R 3/60* (2006.01)
*F23R 3/00* (2006.01)
*F23R 3/06* (2006.01)

(52) U.S. Cl.

CPC ..... *F23R 3/002* (2013.01); *F23R 3/007* (2013.01); *F23R 3/06* (2013.01); *F23R 2900/00017* (2013.01); *F23R 2900/03042* (2013.01); *F23R 2900/03044* (2013.01)

(58) Field of Classification Search

CPC . F23R 3/002; F23R 3/007; F23R 2900/03044
See application file for complete search history.

(56) References Cited

U.S. PATENT DOCUMENTS

| | | | | | |
|---|---|---|---|---|---|
| 4,085,580 | A * | 4/1978 | Slattery | F23R 3/10 | 60/756 |
| 4,422,300 | A * | 12/1983 | Dierberger | F23R 3/007 | 60/753 |
| 4,749,029 | A * | 6/1988 | Becker | F23R 3/002 | 165/169 |
| 4,820,097 | A | 4/1989 | Maeda et al. | | |
| 5,144,793 | A | 9/1992 | Able et al. | | |
| 6,341,485 | B1 * | 1/2002 | Liebe | F23R 3/002 | 60/760 |
| 6,718,774 | B2 | 4/2004 | Razzell | | |
| 6,941,758 | B2 | 9/2005 | Tiemann | | |
| 7,059,133 | B2 | 6/2006 | Gerendas | | |

(Continued)

FOREIGN PATENT DOCUMENTS

| | | | | |
|---|---|---|---|---|
| EP | 1351022 | 10/2003 | | |
| EP | 1712840 | 10/2006 | | |
| GB | 647302 | * 5/1948 | | F23R 3/007 |
| GB | 2173891 | 10/1986 | | |

OTHER PUBLICATIONS

European Search Report dated Mar. 3, 2014 from counterpart App No. 13191950.8.

(Continued)

*Primary Examiner* — Lorne Meade
(74) *Attorney, Agent, or Firm* — Timothy J. Klima; Shuttleworth & Ingersoll, PLC

(57) ABSTRACT

The present invention relates to a tile fastening arrangement of a gas-turbine combustion chamber having a combustion chamber wall with tiles fastened to said combustion chamber wall at a distance from the latter, characterized in that the tile is provided with an annular flange arranged on its side assigned to the combustion chamber wall, said flange being dimensioned to match a recess of the combustion chamber wall and fastened to the combustion chamber wall by means of a fastening element which engages in the combustion chamber wall.

6 Claims, 4 Drawing Sheets

(56) References Cited

U.S. PATENT DOCUMENTS

Figure 1:
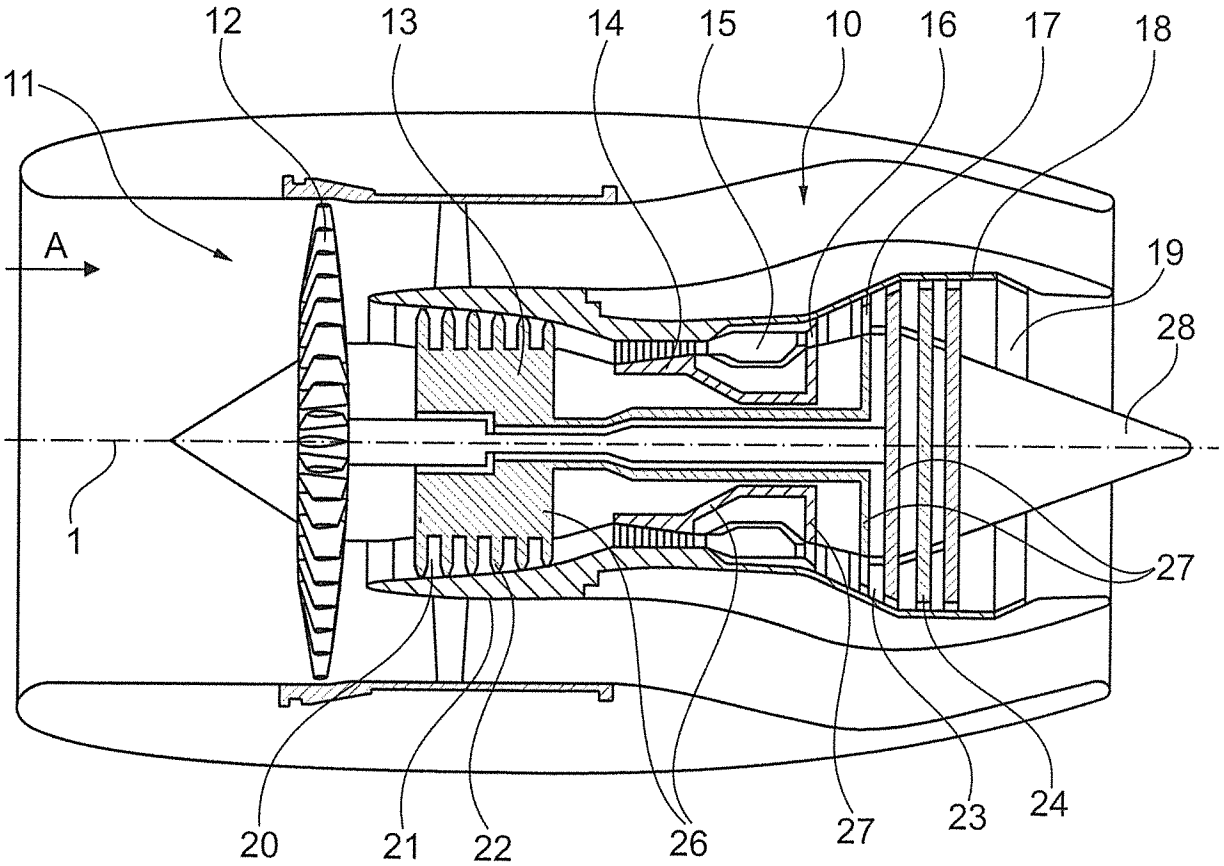

| | | | | |
|---|---|---|---|---|
| 8,833,084 | B2 * | 9/2014 | Carlisle | F23R 3/002 60/752 |
| 2008/0127652 | A1 | 6/2008 | Putz | |
| 2011/0030378 | A1 | 2/2011 | Carlisle | |

OTHER PUBLICATIONS

German Search Report dated Jun. 28, 2013 from counterpart app No. DE 10 2012 023 297.7.

* cited by examiner

SECTION B-B

SECTION B-B

TILE FASTENING ARRANGEMENT OF A GAS-TURBINE COMBUSTION CHAMBER

This application claims priority to German Patent Application 102012023297.7 filed Nov. 28, 2012, the entirety of which is incorporated by reference herein.

This invention relates to a tile fastening arrangement of a gas-turbine combustion chamber in accordance with the features of the generic part of claim 1.

In particular, the invention relates to a combustion chamber of a gas turbine, where tiles are fastened to a combustion chamber wall and arranged at a distance from the combustion chamber wall.

In these so-called double-walled combustion chambers, it is known to fasten the tiles to the combustion chamber wall or the tile carrier, respectively, by means of set screws, which are usually designed in one piece with the tile. This embodiment is used in particular for impingement/effusion tiles too. With tiles of this type, spacers are inserted around the set screw or bolt in order to achieve uniform loading of the bolts or set screws and also to ensure both good sealing and a uniform distance between the tile and the tile carrier.

It is also known, in connection with combustion chambers, to introduce a large amount of the combustion air into the combustion chamber via mixing air openings. Air guide elements or air guide tubes (chutes) are used here for selective alignment of the airflow. The mixing air openings are either integrated into or fastened to the combustion chamber wall, or they are integrated into the tiles. Tiles of this type with integrated mixing air openings and mixing air guide elements are usually manufactured using a casting method.

In combustion chambers, it is desirable to cool the tiles uniformly over their entire surface. The above-described embodiments with set screws or bolts and spacers, respectively, have however the disadvantage that effective impingement/effusion cooling is not possible. The reason for this is that the bolts and spacers do not permit the provision of cooling air passage recesses in their fastening area. The result is high temperatures and temperature gradients in the area where the tiles are fastened to the combustion chamber. This in turn has a negative effect on the fatigue strength of the tiles. This disadvantage is caused, as already mentioned, in particular by the fact that effusion holes cannot be made by means of laser in the area of the integrated bolts or set screws and/or the spacers and the mixing air guide elements, as this would damage the integrated components. This leads to the cooling air film being impaired or interrupted on the hot side of the tile, which in turn brings about the locally high temperatures and temperature gradients as already mentioned.

The object underlying the present invention is to provide a tile fastening arrangement of a gas-turbine combustion chamber which, while being simply designed and easily and cost-effectively producible, avoids the disadvantages of the state of the art and enables good cooling, especially of the tile.

It is a particular object of the present invention to provide solution to the above problematics by the combination of the features of claim 1. Further advantageous embodiments of the present invention become apparent from the other Claims.

In accordance with the invention, the tile is therefore provided with an annular flange arranged on its side facing the combustion chamber wall. This annular flange is dimensioned to match a recess of the combustion chamber wall and either engages in this recess or is in flush contact with the rim of the recess on the combustion chamber wall. The tile is connected to the combustion chamber wall by means of a fastening element, which engages in the recess of the combustion chamber wall and is mechanically connected to the annular flange. This connection to the annular flange can be direct, for which purpose the annular flange has on its inside a thread which meshes with a threaded section of the fastening element. As an alternative to this, it is also possible in accordance with the invention to use a mixing air tube which is provided with an internal thread and screwed to the fastening element. In this embodiment of the invention, the annular flange is clamped between the mixing air guide tube and the fastening element such that the tile is firmly clamped against the combustion chamber wall.

In accordance with the invention, the fastening element is designed round. It can be designed cup-like if no mixing air guide tube is used. It is particularly favourable here if air passage recesses are provided in the centric area of the cup-like design of the fastening element, through which recesses cooling air can be passed to the tile. The tile is preferably also provided with air passage recesses, adjoining the centric area of the fastening element, to pass cooling air to the hot side of the tile.

By means of the embodiment in accordance with the invention, it is thus possible to achieve efficient impingement/effusion cooling between the tile and the combustion chamber wall (tile carrier). As a result, high temperatures in the area where the tile is fastened to the combustion chamber wall are avoided. The annular flange provided in accordance with the invention can be dimensioned here such that it needs only a very small surface area of the tile, so that during operation there is no disruption of the cooling air film on the hot side of the tile.

A further substantial advantage of the embodiment in accordance with the invention is that the annular flange can have a very low height. Due to this lower height of the annular flange compared with a set screw, the provision of effusion cooling air recesses by means of laser or electron beams, for example, is hindered to a lesser extent. As a result, it is possible to position effusion cooling air recesses closer to the connection point, i.e. to the annular flange. This too means that the cooling film on the hot side of the tile is disrupted only to a minor extent or not at all.

The tile fastening arrangement in accordance with the present invention is characterized by a variety of considerable advantages. Firstly it is possible to achieve a lower structural height, by which it is consequently possible to have smaller combustion chamber casings or larger combustion chamber volumes with the same installation space. This leads to a lower weight of the combustion chamber and to savings on material and production costs. Furthermore, it is possible in accordance with the invention to cool the tile fastening area effectively, thereby avoiding hot areas which occur in the state of the art. This leads to a longer service life of the combustion chamber tiles. Longer service life is also achieved in that the tiles are cooled more uniformly and in that the high temperature gradients known from the state of the art are avoided. The cause of this is the substantially undisrupted formation of the cooling film when the tile fastening arrangement in accordance with the invention is used. The combination of the tile fastening with the mixing air guide tubes (chutes) possible in accordance with the invention also leads to optimization of cooling and to smaller surfaces needed for cooling. The result is therefore a smaller uncooled surface. This too leads, as already mentioned, to the avoidance of high temperature gradients and results in a longer service life.

In the embodiment in accordance with the invention, it must furthermore be taken into account that the connection to the fastening element is assured by means of the clamping effect occurring due to a power flow in the "cold" area. This means that the thermal and mechanical loads occurring in the area of the tile and the tile fastening do not act together, which is a considerable advantage of the solution in accordance with the invention.

The mixing air guide tube can, in accordance with the invention, be designed either as a separate part or in one piece with the tile. In the case of a separate mixing air guide tube, it may be favourable that the effusion holes in the mixing air guide tube can be manufactured more simply and accurately, so that the mixing air guide tube too can be better cooled.

The fastening element can have different thread sizes, depending on the respective sizes and the specific conditions of use. This results in an optimum adaptability of the solution in accordance with the invention to differing requirements.

The air passage recesses (effusion cooling holes) can, in the solution in accordance with the invention, be designed perpendicular to the center plane or inclined. To that extent the invention offers a variety of possible adaptations to the respective design requirements.

A further and crucial advantage of the invention is that a very low clearance is achieved at the point where the tile is fastened to the combustion chamber wall by means of the fastening element. This permits very good positioning between the tile and the combustion chamber wall, which in turn influences the assignment of the air passage recesses, so that they can be arranged in a favourable assignment to one another.

Figure 2:
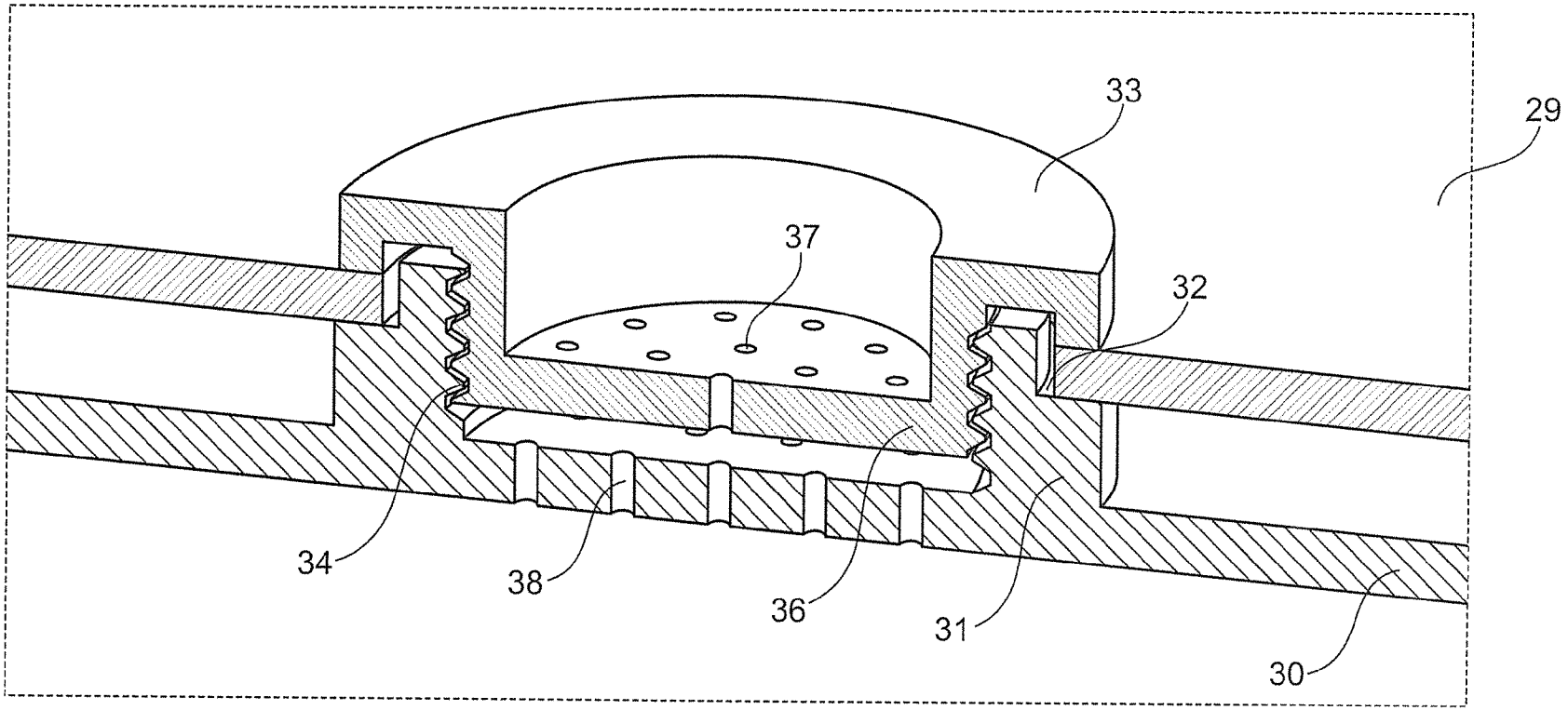
Figure 3:
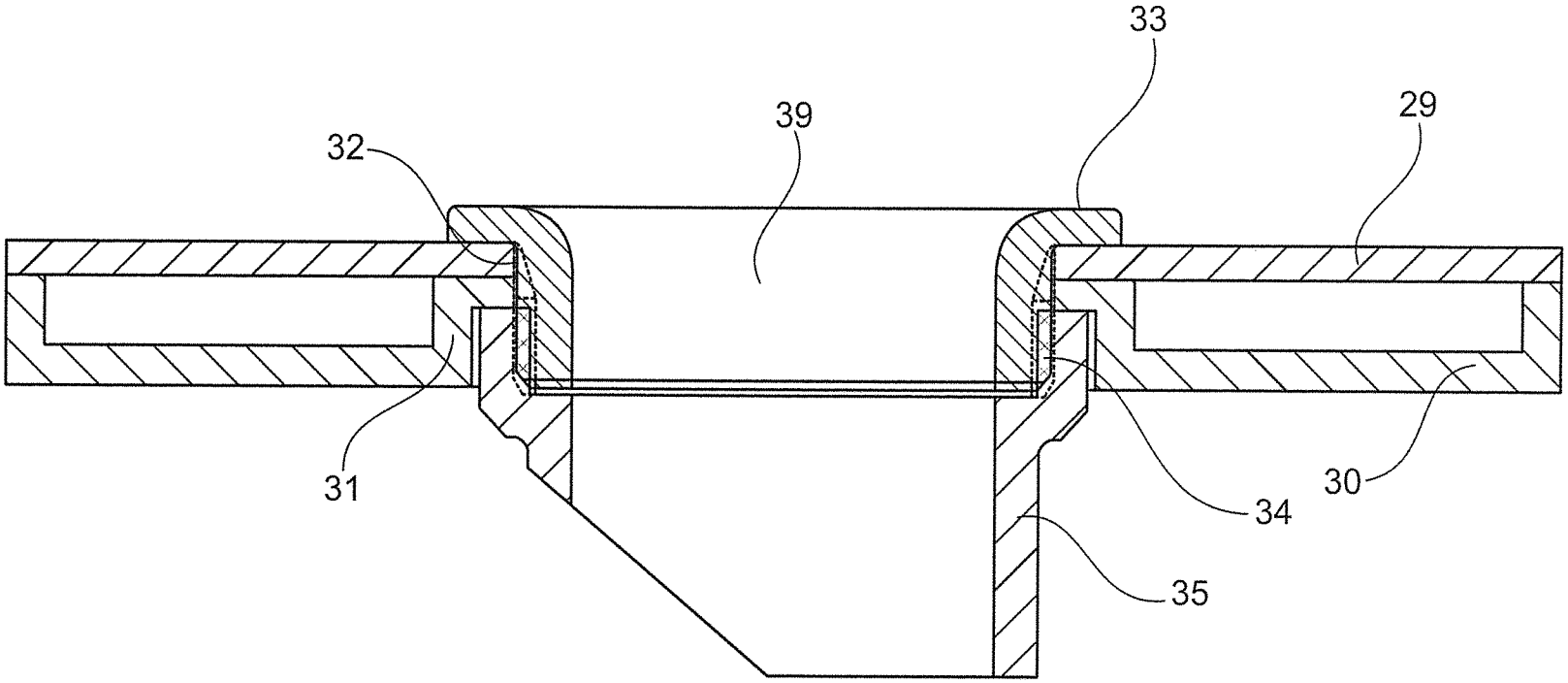
Figure 4:
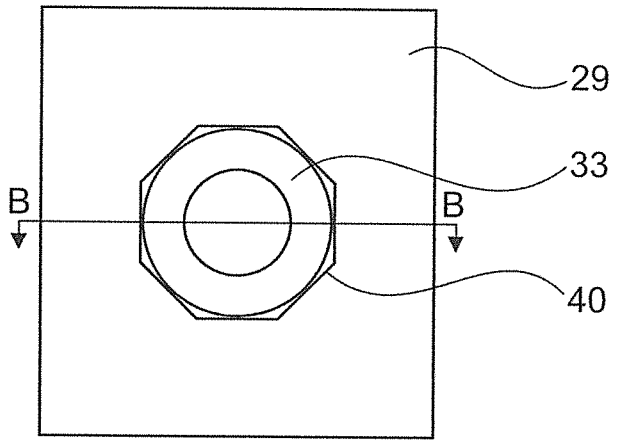
Figure 5:
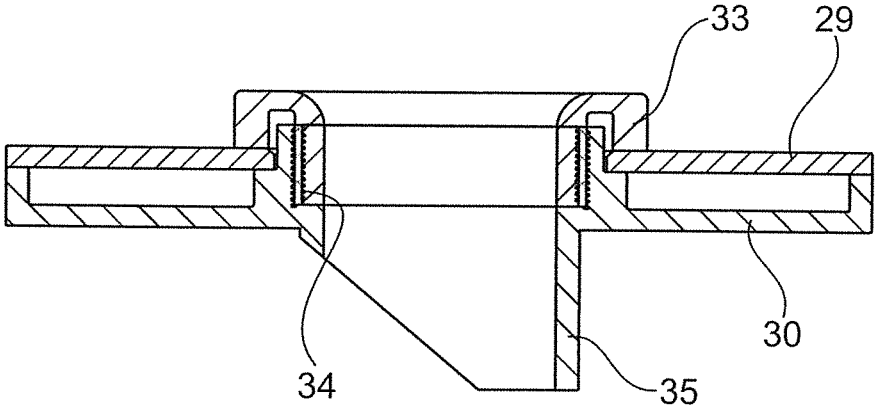

The present invention is described in the following in light of the accompanying drawing, showing exemplary embodiments. In the drawing, FIG. 1 shows a schematic representation of a gas-turbine engine in accordance with the present invention, FIG. 2 shows a simplified perspective partial sectional view of a fastening element in accordance with the present invention with air passage recesses, FIG. 3 shows a representation, by analogy with FIG. 2, of an exemplary embodiment of a fastening element in accordance with the present invention provided with a mixing air guide tube, FIG. 4 shows a top view onto a further exemplary embodiment, and FIG. 5 shows a sectional view of the exemplary embodiment shown in FIG. 4.

The gas-turbine engine 10 in accordance with FIG. 1 is a generally represented example of a turbomachine where the invention can be used. The engine 10 is of conventional design and includes in the flow direction, one behind the other, an air inlet 11, a fan 12 rotating inside a casing, an intermediate-pressure compressor 13, a high-pressure compressor 14, a combustion chamber 15, a high-pressure turbine 16, an intermediate-pressure turbine 17 and a low-pressure turbine 18 as well as an exhaust nozzle 19, all of which being arranged about a center engine axis 1.

The intermediate-pressure compressor 13 and the high-pressure compressor 14 each include several stages, of which each has an arrangement extending in the circumferential direction of fixed and stationary guide vanes 20, generally referred to as stator vanes and projecting radially inwards from the engine casing 21 in an annular flow duct through the compressors 13, 14. The compressors furthermore have an arrangement of compressor rotor blades 22 which project radially outwards from a rotatable drum or disk 26 linked to hubs 27 of the high-pressure turbine 16 or the intermediate-pressure turbine 17, respectively.

The turbine sections 16, 17, 18 have similar stages, including an arrangement of fixed stator vanes 23 projecting radially inwards from the casing 21 into the annular flow duct through the turbines 16, 17, 18, and a subsequent arrangement of turbine blades 24 projecting outwards from a rotatable hub 27. The compressor drum or compressor disk 26 and the blades 22 arranged thereon, as well as the turbine rotor hub 27 and the turbine rotor blades 24 arranged thereon rotate about the engine axis 1 during operation.

FIGS. 2 and 3 each show simplified perspective partial sectional views. A combustion chamber wall 29 is illustrated here on which a tile 30 is mounted at a distance from said combustion chamber wall 29. In accordance with the invention, the combustion chamber wall 29 has a circular recess 32 in the fastening area of the tile. This recess can also be non-round, for example polygonal. The tile 30 is provided with an annular flange 31 designed in one piece on the tile 30 and dimensioned such that, in accordance with FIG. 2, it engages in the recess 32. The annular flange is provided on its inside with a thread 34. In the inner area of the annular flange 31, the tile has a plurality of air passage recesses 38 on its wall. This makes it possible to pass cooling air through the tile 30 and, as described, to provide a cooling air film on the hot side of the tile 30.

FIG. 2 furthermore shows an exemplary embodiment of a fastening element 33 in accordance with the invention. This element is designed in the form of a round insert having a cup-like structure. The fastening element 33 has an external thread which can be screwed to the thread 34 of the annular flange 31. In the centric area, the fastening element 33 is provided with a plurality of air passage recesses 37, through which cooling air can be passed to the outside of the tile 30.

As the representation in FIG. 2 shows, the fastening element 33 is firmly screwed to the annular flange 31 of the tile 30. The annular flange 31 is here in sealing contact with the rim of the recess 32 of the combustion chamber wall 29, so that the undesired passage of leakage flows is prevented. The sealing effect is also ensured in that the fastening element 33 is, as shown in FIG. 2, also in contact with the outside of the combustion chamber wall 29. With the design shown in FIG. 2, it can furthermore be discerned that the outer diameter of the projecting area of the annular flange 31 and the inner diameter of the recess 32 permit a clearance, so that production inaccuracies or thermal expansions can be compensated for without the sealing effect being affected. A tight clearance fit at individual fastening points can have a positive effect on the positioning of the tile and hence of the mixing air openings inside the combustion chamber. Furthermore, a more precise alignment of the cooling air holes in the tile carrier to the cooling air holes in the tile is possible.

FIG. 3 shows a representation by analogy with FIG. 2. Identical parts are given the same reference numerals. In the representation of FIG. 3, the fastening element 33 is designed tube-shaped. It is not screwed using its thread 34 against the annular flange 31, but clamps the annular flange 31 against a mixing air guide tube (chute) which is provided with an internal thread. The fastening element 33 is thus in positive engagement with the mixing air guide tube, and thus clamps the rim area of the recess 32 in the combustion chamber wall 29 and the annular flange 31 in a sealing contact. It is thus possible to manufacture the mixing air guide tube 35 in a simple and cost-effective embodiment and mount it on the combustion chamber wall 29 or the tile 30, respectively. Due to an optimized design of the inflow area 39 of the fastening element 33, for example by suitably rounding it, optimized flow guidance is assured.

FIGS. 4 and 5 show in schematic representation a further exemplary embodiment of the present invention. Identical parts are given the same reference numerals. In the view shown in FIG. 4, it can be discerned that the fastening element 33 is provided on its outer contour with tool engaging means

40. The latter can be designed in the form of a hexagon or another polygonal embodiment or in the form of holes or similar for engaging a suitable tool.

FIG. 5 shows an embodiment in which the mixing air guide tube 35 is designed in one piece with the tile 30. The mixing air guide tube 35 is therefore also fastened by screwing of the tile 30.

LIST OF REFERENCE NUMERALS

1 Engine axis
10 Gas-turbine engine/core engine
11 Air inlet
12 Fan
13 Intermediate-pressure compressor (compressor)
14 High-pressure compressor
15 Combustion chamber
16 High-pressure turbine
17 Intermediate-pressure turbine
18 Low-pressure turbine
19 Exhaust nozzle
20 Guide vanes
21 Engine casing
22 Compressor rotor blades
23 Stator vanes
24 Turbine blades
26 Compressor drum or disk
27 Turbine rotor hub
28 Exhaust cone
29 Combustion chamber wall
30 Tile
31 Annular flange
32 Recess
33 Fastening element
34 Thread
35 Mixing air guide tube
36 Centric area
37 Air passage recess
38 Air passage recess
39 Inflow area
40 Tool engaging means

What is claimed is:

1. A tile fastening arrangement of a gas-turbine combustion chamber comprising:

a tile having an annular flange, said annular flange having an interior screw thread;

a combustion chamber wall having a circular hole through an outer side of said combustion chamber wall facing away from the tile, said tile fastened to said combustion chamber wall at a distance from said combustion chamber wall; and a cup-shaped fastening element comprising a rim, a cylindrical body, and a base, said rim extending around an end of said cylindrical body opposite said base, said cylindrical body having an external screw thread, wherein said annular flange is located on a side of said tile facing an inner side of said combustion chamber wall, an outer diameter of a top portion of said annular flange dimensioned to fit within an inner diameter of said circular hole, an outer diameter of a bottom portion of said annular flange dimensioned to be greater than said inner diameter of said circular hole, said tile fastened to the combustion chamber wall by said top portion inserted into said circular hole with said bottom portion contacting said inner side and said cylindrical body passing through said circular hole with said rim contacting said outer side and said external screw thread engaging said interior screw thread within said circular hole in the combustion chamber wall.

2. The tile fastening arrangement in accordance with claim 1, wherein said rim of said fastening element is round and a plurality of first air passage holes are located in a center area of said base.

3. The tile fastening arrangement in accordance with claim 2, wherein said tile includes a plurality of second air passage holes at least within an area of the annular flange.

4. The tile fastening arrangement in accordance with claim 1, wherein the fastening element includes on said rim a tool engaging surface.

5. A tile fastening arrangement of a gas-turbine combustion chamber comprising:

a plurality of tiles, each one of said plurality of tiles having an annular flange, said annular flange having an interior screw thread;

a combustion chamber wall with said plurality of tiles fastened to said combustion chamber wall at a distance from said combustion chamber wall, said combustion chamber wall having at least one circular hole; and a cup-shaped fastening element comprising a rim, a cylindrical body, and a base, said rim extending around an end of said cylindrical body opposite said base, said base having a plurality of first air passage holes, said cylindrical body having an external screw thread, wherein said cylindrical body passes through the circular hole from a side of said combustion chamber wall facing away from the tiles, said rim contacting said side and said external screw thread connected directly to the interior screw thread of said annular flange of said one of said plurality of tiles.

6. The tile fastening arrangement in accordance with claim 5, further comprising a plurality of second air passage holes located within an area of the annular flange.

* * * * *